US007517294B2

(12) United States Patent
Tsai

(10) Patent No.: US 7,517,294 B2
(45) Date of Patent: Apr. 14, 2009

(54) DUAL-BLADDER INFLATABLE BALL

(76) Inventor: I-Chen Tsai, No. 24, Ping-Hsiang Rd., Feng-Lin Chen, Hua-Lien Hsien (TW)

( * ) Notice: Subject to any disclaimer, the term of this patent is extended or adjusted under 35 U.S.C. 154(b) by 175 days.

(21) Appl. No.: 11/670,511

(22) Filed: Feb. 2, 2007

(65) Prior Publication Data

US 2008/0188333 A1 Aug. 7, 2008

(51) Int. Cl.
*A63B 41/02* (2006.01)

(52) U.S. Cl. ..... 473/594; 473/604; 473/610; 473/611

(58) Field of Classification Search ..... 473/603–605, 473/609–611, 593, 594, 599
See application file for complete search history.

(56) References Cited

U.S. PATENT DOCUMENTS 1,690,162 A * 11/1928 Fitzpatrick ..... 473/611
1,990,374 A * 2/1935 Goldsmith ..... 473/611
2,065,121 A * 12/1936 De Laney et al. ..... 473/610
4,320,776 A * 3/1982 Yang ..... 473/610
4,842,563 A * 6/1989 Russell ..... 446/221
5,070,610 A * 12/1991 Leslie ..... 473/594
5,098,329 A * 3/1992 Tseng ..... 473/610
5,891,000 A * 4/1999 Phillips ..... 473/594
6,413,177 B1 * 7/2002 Guenther et al. ..... 473/605
6,422,960 B1 * 7/2002 Touhey et al. ..... 473/593
6,572,499 B2 * 6/2003 Davies ..... 473/604
6,620,472 B1 * 9/2003 Shepard et al. ..... 473/609
6,645,100 B2 * 11/2003 Guenther et al. ..... 473/605

* cited by examiner

*Primary Examiner*—Steven Wong
(74) *Attorney, Agent, or Firm*—Hunton & Williams LLP

(57) ABSTRACT

A dual-bladder inflatable ball includes: a valve unit; an outer cover defining a confining chamber therein and connected sealingly to the valve unit; a bladder unit enclosed in the confining chamber in the outer cover, connected to the valve unit, and including an inner bladder and an outer bladder enclosing the inner bladder and disposed between the outer cover and the inner bladder. The bladder unit is operable between an inflated state, where the inner and outer bladders are spherical in shape and the inner bladder abuts against the outer bladder, and a deflated state, where the inner and outer bladders are non-spherical in shape and cooperatively define a gap therebetween. The outer bladder has a first elongation percentage, and the inner bladder has a second elongation percentage greater than the first elongation percentage of the outer bladder.

1 Claim, 6 Drawing Sheets

DUAL-BLADDER INFLATABLE BALL

BACKGROUND OF THE INVENTION

1. Field of the Invention

This invention relates to an inflatable ball, more particular to an inflatable ball having dual bladders enclosed in an outer cover.

2. Description of the Related Art

As shown in FIG. 1, a conventional inflatable ball includes an outer cover 1, a rubber bladder layer 2, and a valve unit 3 provided on the rubber bladder layer 2 and extending through the outer cover 1 and the rubber bladder layer 2. The valve unit 3 includes a base portion 301 connected to the rubber bladder layer 2 and a valve portion 302 inserted into the base portion 301. However, the conventional inflatable ball has following disadvantages. The inflatable ball tends to lose its desired shape by virtue of the material employed for the rubber bladder layer 2 (i.e., vulcanized rubber) when the rubber bladder layer 2 is over-inflated. Moreover, the rubber bladder layer 2 is made from a single layer of rubber, so that a leakage problem is likely to occur. In addition, since the base portion 301 of the valve unit 3 is made from an elastic rubber material, the valve portion 302 is likely to be moved through the base portion 301 and thus falls into the rubber bladder layer 2 when being inserted into the base portion 301.

FIG. 2 shows another conventional inflatable ball, which includes an outer cover 1, a rubber bladder unit 2, and a valve unit 3 provided on the rubber bladder unit 2 and extending through the outer cover 1 and the rubber bladder unit 2. The rubber bladder unit 2 includes a rubber layer 201 and a winding thread 202 wound around the rubber layer 201. The valve unit 3 includes a base portion 301 and a valve portion 302 inserted into the base portion 301. The winding thread 202 prevents over-inflation of the rubber layer 201. However, the requirement for a winding apparatus makes the manufacture of the inflatable ball complicated, and the problem of uneven winding and the problem of falling of the valve portion 302 from the base portion 301 are likely to occur.

FIG. 3 shows yet another conventional inflatable ball, which includes an outer cover 1, a rubber bladder unit 2, and a valve unit 3 provided on the rubber bladder unit 2 and extending through the outer cover 1 and the rubber bladder unit 2. The rubber bladder unit 2 includes a rubber layer 201 and fabric tapes 202 provided on the rubber layer 201. The valve unit 3 includes a base portion 301 and a valve portion 302 inserted into the base portion 301. The fabric tapes 202 prevent over-inflation of the rubber layer 201. However, the fabric tapes 202 have a problem of uneven tension, so that the shape and size of the inflatable ball cannot be desirably maintained. Furthermore, the procedure for attaching the fabric tapes 202 to the rubber layer 201 is complicated. The problem of falling of the valve portion 302 from the base portion 301 is also likely to occur in this inflatable ball.

SUMMARY OF THE INVENTION

Therefore, the object of this invention is to provide an inflatable ball having dual bladders enclosed in an outer cover.

According to this invention, an inflatable ball includes: a valve unit; an outer cover defining a confining chamber therein and connected sealingly to the valve unit; a bladder unit enclosed in the confining chamber in the outer cover, connected to the valve unit, and including an inner bladder and an outer bladder enclosing the inner bladder and disposed between the outer cover and the inner bladder, the bladder unit being operable between an inflated state, where the inner and outer bladders are spherical in shape and the inner bladder abuts against the outer bladder, and a deflated state, where the inner and outer bladders are non-spherical in shape and cooperatively define a gap therebetween, the outer bladder having a first elongation percentage, the inner bladder having a second elongation percentage greater than the first elongation percentage of the outer bladder.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
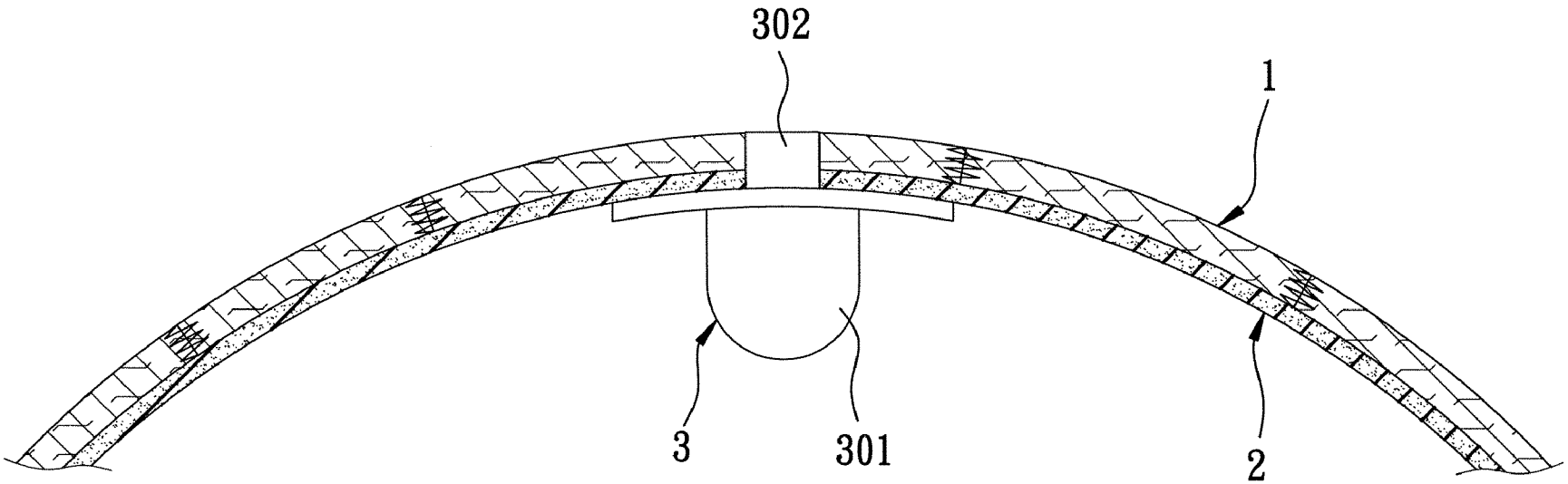
FIG. 1 PRIOR ART
FIG. 1 is a fragmentary partly sectional view of a conventional inflatable ball.
Figure 2:
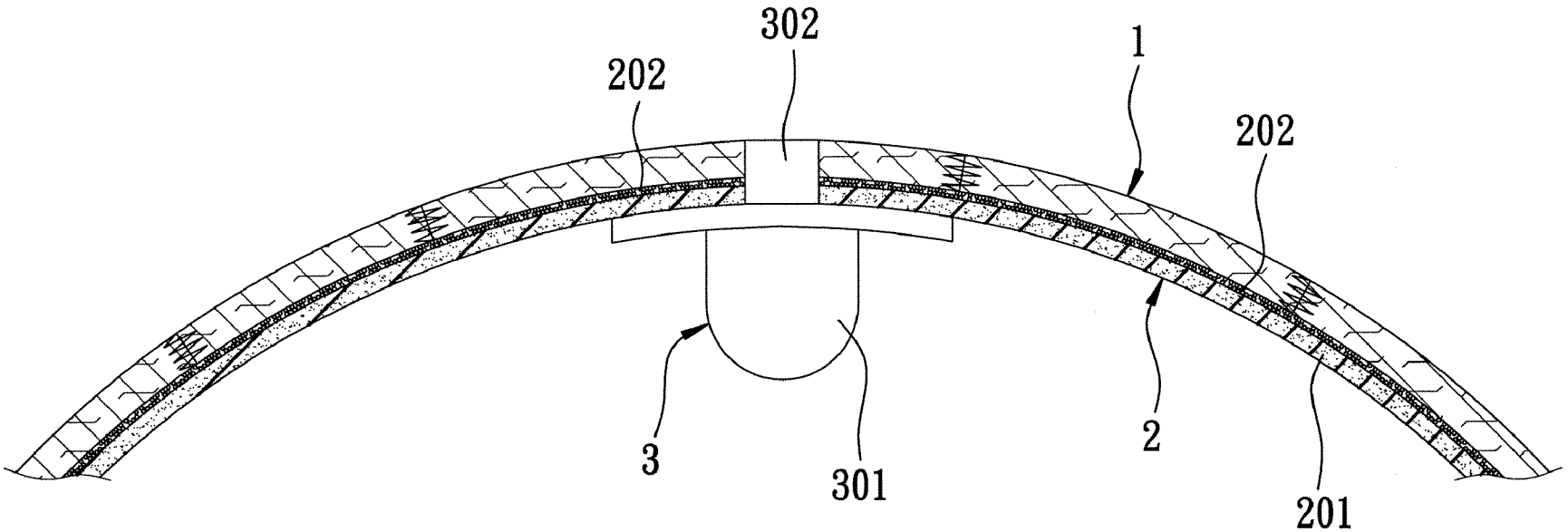
FIG. 2 PRIOR ART
FIG. 2 is a fragmentary partly sectional view of another conventional inflatable ball.
Figure 3:
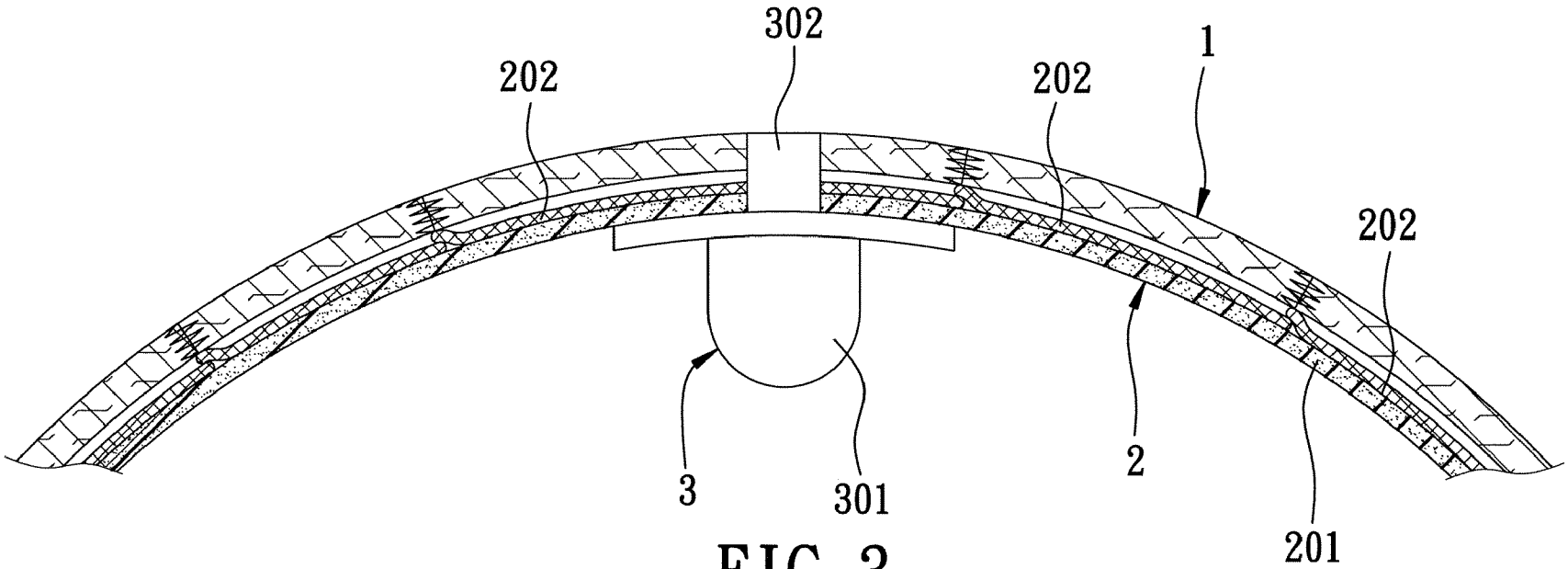
FIG. 3 PRIOR ART
FIG. 3 is a fragmentary partly sectional view of yet another conventional inflatable ball.
Figure 4:
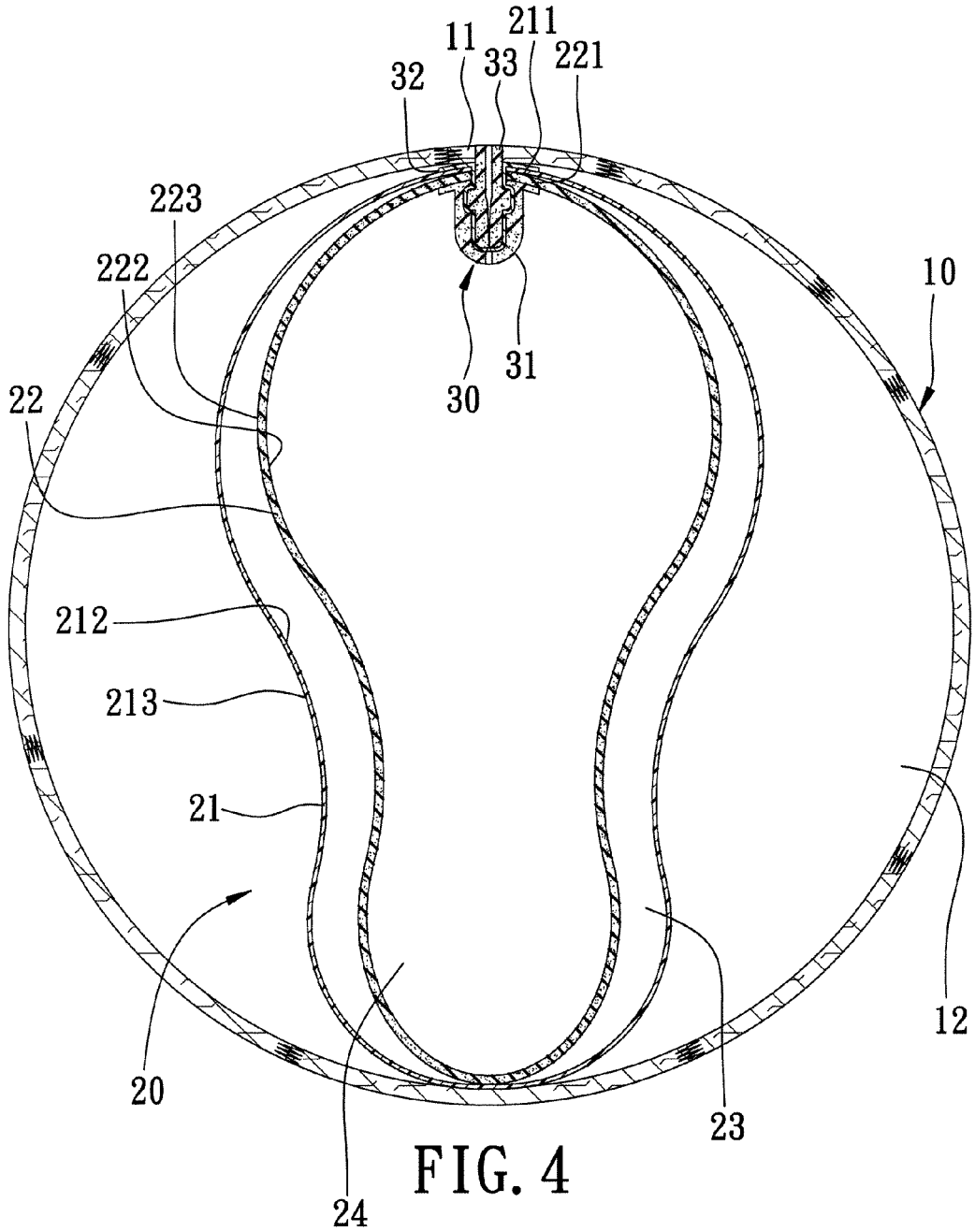
FIG. 4 is a schematic cross-sectional view of the preferred embodiment of an inflatable ball according to this invention at a deflated state.
Figure 5:
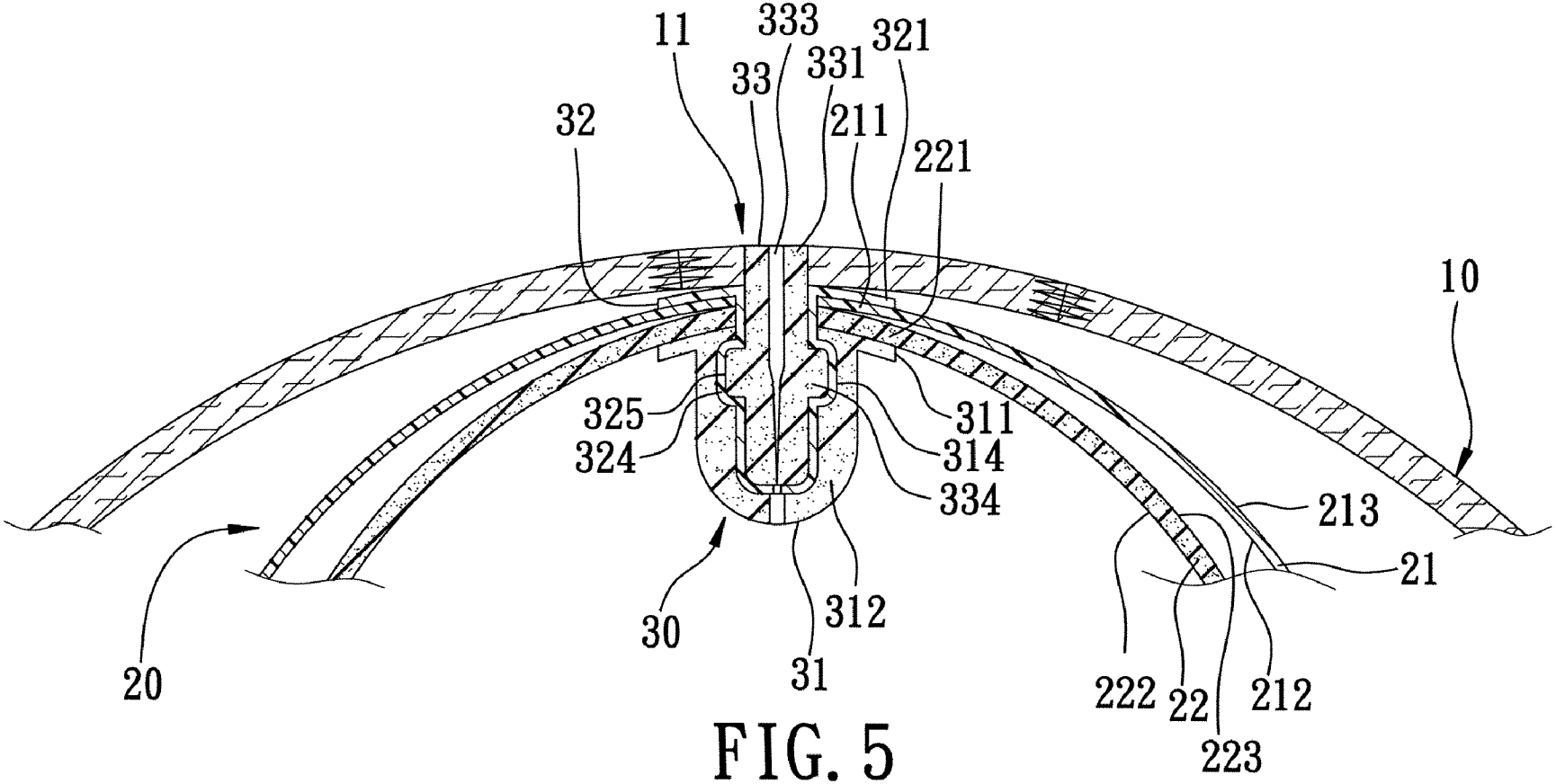
FIG. 5 is a fragmentary cross-sectional view of the preferred embodiment.

Referring to FIGS. 4 and 5, the preferred embodiment of an inflatable ball according to the present invention is shown to include an outer cover 10, a bladder unit 20, and a valve unit 30.

The outer cover 10 is made from leather, defines a confining chamber 12 therein, and has a hole 11. The bladder unit 20 is enclosed in the confining chamber 12 in the outer cover 10, and includes an inner bladder 22 and an outer bladder 21 enclosing the inner bladder 22. The outer bladder 21 has an outer peripheral surface 213, an inner peripheral surface 212, and a hole 211. The inner bladder 22 has an outer peripheral surface 223, an inner peripheral surface 222, and a hole 221, and defines an inflating space 24.

Figure 6:
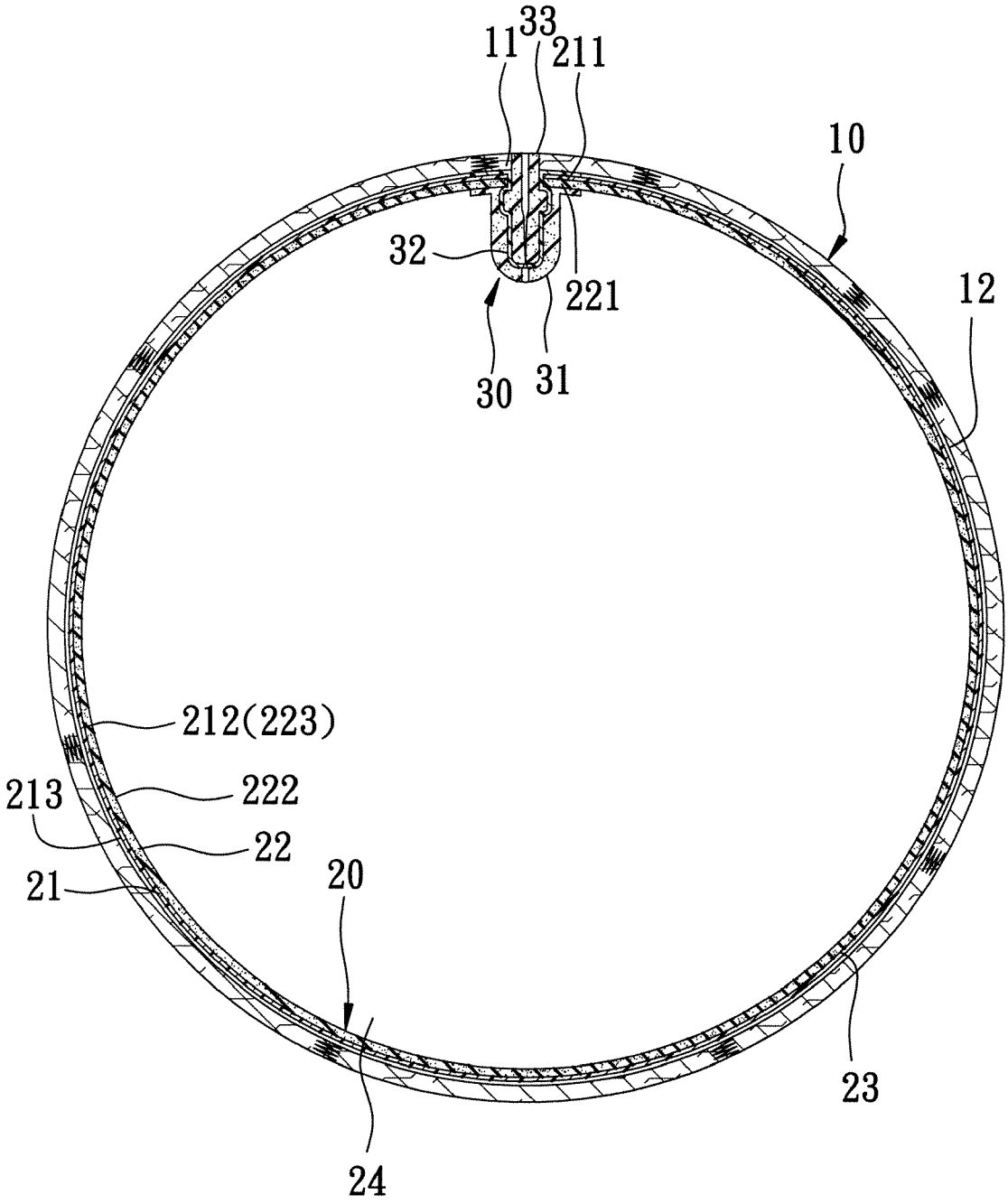
FIG. 6 is a schematic cross-sectional view of the preferred embodiment at an inflated state.

The bladder unit 20 is operable between an inflated state, where the inner and outer bladders 22, 21 are spherical in shape, where the outer peripheral surface 213 of the outer bladder 21 abuts against the outer cover 10, and where the outer peripheral surface 223 of the inner bladder 22 abuts against the inner peripheral surface 212 of the outer bladder 21 (see FIG. 6), and a deflated state, where the inner and outer bladder 22, 21 are non-spherical in shape and where the outer peripheral surface 223 of the inner bladder 22 and the inner peripheral surface 212 of the outer bladder 21 cooperatively define a gap 23 therebetween (see FIG. 4). The outer bladder 21 has a first elongation percentage and is made from a material selected from the group consisting of thermoplastic polyurethane (TPU), polyvinyl chloride (PVC), ethylene-vinyl acetate (EVA), natural rubber, artificial rubber, and latex. The inner bladder 22 is made from a material selected from the group consisting of thermoplastic polyurethane, polyvinyl chloride, ethylene-vinyl acetate, natural rubber, artificial rubber, and latex, and has a second elongation percentage greater than the first elongation percentage of the outer bladder 21. That is, the materials for the outer and inner bladders 21, 22 can be chosen based on actual requirements as long as the first elongation percentage of the outer bladder 21 is smaller than the second elongation percentage of the inner bladder 22 such that inflation of the inner bladder 22 can be controlled and limited by the outer bladder 21 to thereby prevent over-inflation of the inflatable ball. For example, in the preferred embodiment of this invention, the outer bladder 21 is made from a plurality of thermoplastic polyurethane (TPU) pieces joined together using high frequency or ultrasonic welding techniques. The inner bladder 22 is made from vulcanized rubber.

Preferably, as shown in FIG. 5, the valve unit 30 includes a slit-type valve 33 extending through the hole 11 in the outer cover 10, the hole 211 in the outer bladder 21, and the hole 221 in the inner bladder 22. The valve unit 30 further includes a hollow valve-supporting seat 31 and a hollow valve-retaining member 32 extending fittingly into the valve-supporting seat 31. The slit-type valve 33 extends fittingly into the valve-retaining member 32. Each of the valve-supporting seat 31 and the valve-retaining member 32 has a rim portion 311, 321 extending outwardly therefrom and secured to the inner peripheral surface 222 of the inner bladder 22 and the outer peripheral surface 213 of the outer bladder 21, respectively, using, for example, high frequency or ultrasonic welding techniques. It should be noted that the rim portions 311, 321 can be secured to the outer peripheral surface 223 of the inner bladder 22 and inner peripheral surface 212 of the outer bladder 21, respectively.

Preferably, the valve-supporting seat 31 has an inner wall 312 formed with an annular recess 314. The valve-retaining member 32 has an annular portion 324 fitted into the annular recess 314 and defining an annular groove 325. The slit-type valve 33 has an annular protrusion 334 received fittingly in the annular groove 325 in the annular portion 324 of the valve-retaining member 32. With such configuration, the problem of undesired falling of the slit-type valve 33 into the inflating space 24 can be avoided.

In this invention, the material for the valve-supporting seat 31 can be the same as or different from that of the inner bladder 22. Similarly, the material for the valve-retaining member 32 can be the same as or different from that of the outer bladder 21. The slit-type valve 33 is made from rubber. Preferably, the elongation percentage of the valve-retaining member 32 is smaller than that of the valve-supporting seat 31 so as to enhance the effect in preventing the falling of the slit-type valve 33 into the inflating space 24 in the inner bladder 22.

With the dual-bladder structure, i.e., the inner and outer bladders 22, 21, according to this invention, the over-inflation and the leakage drawbacks can be avoided so that the inflatable ball can be maintained at a desired size and shape. Besides, pressure exerted on the outer cover 10 by the bladder unit 20 can also be reduced to thereby improve the durability of the inflatable ball. Moreover, with the inclusion of the valve-retaining member 32 in the inflatable ball of this invention, falling of the slit-type valve 33 into the inflating space 24 in the inner bladder 22 can be avoided. Furthermore, the present invention eliminates the winding and taping processes and use of a winding machine, thereby resulting in lower manufacturing costs.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A dual-bladder inflatable ball comprising:

a valve unit;

an outer cover defining a confining chamber therein and connected sealingly to said valve unit;

a bladder unit enclosed in said confining chamber in said outer cover, connected to said valve unit, and including an inner bladder and an outer bladder enclosing said inner bladder and disposed between said outer cover and said inner bladder, said bladder unit being operable between an inflated state, where said inner and outer bladders are spherical in shape and said inner bladder abuts against said outer bladder, and a deflated state, where said inner and outer bladders are non-spherical in shape and cooperatively define a gap therebetween, said outer bladder having a first elongation percentage, said inner bladder having a second elongation percentage greater than said first elongation percentage of said outer bladder;

wherein said valve unit includes a slit-type valve, each of said outer cover and said inner and outer bladders being formed with a hole for extension of said slit-type valve therethrough, said valve unit further including a hollow valve-supporting seat and a hollow valve-retaining member extending fittingly into said valve-supporting seat, said slit-type valve extending fittingly into said valve retaining member, each of said valve-supporting seat and said valve-retaining member having a rim portion extending outwardly therefrom and secured to a periphery of said hole in a respective one of said inner and outer bladders; and wherein said valve-supporting seat is made from a material having a third elongation percentage, said valve-retaining member made from a material having a fourth elongation percentage smaller than said third elongation percentage of said valve-supporting seat.

* * * * *